US007283760B2

(12) United States Patent
Condello et al.

(10) Patent No.: US 7,283,760 B2
(45) Date of Patent: Oct. 16, 2007

(54) VARIABLE NIP PRESSURE FUSING SYSTEM

(75) Inventors: Anthony S. Condello, Webster, NY (US); Donald M. Bott, Rochester, NY (US); Jeremy C. De Jong, Orchard Park, NY (US); Roger G. Leighton, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 136 days.

(21) Appl. No.: 11/237,156

(22) Filed: Sep. 28, 2005

(65) Prior Publication Data

US 2007/0071466 A1 Mar. 29, 2007

(51) Int. Cl.
*G03G 15/20* (2006.01)

(52) U.S. Cl. ..... 399/45; 399/328

(58) Field of Classification Search ..... 399/45, 399/67, 320, 328

See application file for complete search history.

(56) References Cited

U.S. PATENT DOCUMENTS

| | | | | |
|---|---|---|---|---|
| 3,934,113 | A | 1/1976 | Bar-on | |
| 4,042,804 | A | 8/1977 | Moser | |
| 5,436,711 | A | 7/1995 | Hauser | |
| 5,998,761 | A | 12/1999 | Berkes et al. | |
| 6,289,587 | B1 | 9/2001 | Battat et al. | |
| 6,819,890 | B1 | 11/2004 | Bott et al. | |
| 7,031,648 | B2 * | 4/2006 | Takashi et al. | 399/307 |
| 2002/0061211 | A1 * | 5/2002 | Kamijo et al. | 399/328 |
| 2002/0102115 | A1 * | 8/2002 | Sato et al. | 399/313 |
| 2004/0028420 | A1 * | 2/2004 | Aslam et al. | 399/45 |
| 2004/0149710 | A1 * | 8/2004 | Sanpei et al. | 219/216 |
| 2004/0151515 | A1 * | 8/2004 | Nakayama | 399/67 |

FOREIGN PATENT DOCUMENTS

| | | | |
|---|---|---|---|
| JP | 05024132 A | * | 2/1993 |
| JP | 11015321 A | * | 1/1999 |
| JP | 2004239958 A | * | 8/2004 |

* cited by examiner

*Primary Examiner*—Quana Grainger
(74) *Attorney, Agent, or Firm*—Fay Sharpe LLP; Eugene Palazzo

(57) ABSTRACT

A fuser system of a xerographic device provides a fuser member, and a pressure member supported for pressure engagement with the fuser member. The pressure member includes an inner layer and an outer layer. The inner layer is variably pressurized for controlled change of the effective hardness of the outer layer. Controlling the effective hardness of the outer layer can be in response to the media paper weight and/or image content being processed though the xerographic device.

23 Claims, 4 Drawing Sheets

VARIABLE NIP PRESSURE FUSING SYSTEM

BACKGROUND

This disclosure relates to a fusing system that includes a variable-nip pressure member that can be selectively modified in order to modify the dwell time for a given fusing member configuration and set temperature which enables the rapid optimization of fix and gloss for a given toner image (i.e. image type such as text, full pictorial, etc.) on a given substrate or media.

In the art of xerography or other similar image reproducing arts, a latent electrostatic image is formed on a charge-retentive surface, i.e., a photoconductor or photoreceptor. To form an image on the charge-retentive surface, the surface is first provided with a uniform charge after which it is exposed to a light or other appropriate image of an original document to be reproduced. The latent electrostatic image thus formed is subsequently rendered visible by applying any one of numerous toners specifically designed for this purpose.

It should be understood that for the purposes of the present disclosure, the latent electrostatic image may be formed by means other than by the exposure of an electrostatically charged photosensitive member to a light image of an original document. For example, the latent electrostatic image may be generated from information electronically stored or generated, and this information in digital form may be converted to alphanumeric images by image generation electronics and optics. The particular method by which the image is formed is not critical to the present disclosure, and any such suitable method may be used.

In a typical xerographic device, the toner image formed is transferred to an image receiving substrate such as paper. After transfer to the image receiving substrate, the image is made to adhere to the substrate using a fuser apparatus. To date, the use of simultaneous heat and contact pressure for fusing toner images has been the most widely accepted commercially, the most common being systems that utilize a pair of pressure engaged, members, i.e. rolls or belts.

The use of pressure engaged rolls for fixing toner images is well known in the art. See, for example, U.S. Pat. Nos. 6,289,587, 5,998,761, 4,042,804 and 3,934,113.

At the time of initial set-up of a xerographic device, the fuser system is set to be within certain specifications. Some of these specifications include nip, load, and speed. Other parameters of the fuser system include dwell time, pressure, and creep. Dwell time (nip width/process speed) is one of the more significant drivers of image fix and quality. Changes in process speed may be made in response to incoming job media type and image percent (%) area coverage. Creep, which is the release surface's % extension in the nip, is important with respect to enabling self-stripping of the paper from the fuser member. Low area coverage (text) images may require only low levels of creep, while high area coverage images require higher levels of creep to self-strip from the fusing member.

Once initially set, the nip width of a typical fuser is not changed during operation of the xerographic device. Unfortunately, several internal and external factors can cause the fuser system to drift outside of the designated specifications. For example, in a typical soft-on-hard roll pair in which the soft roll is the driving roll, the fuser system may begin operating outside of specifications due to, e.g., hardening of the roll materials over time. Typical fuser roll systems include some materials such as silicone materials that tend to become harder or softer over time at unpredictable rates. This hardening causes large reductions in both dwell time and potentially creep, which causes premature failure (e.g., smaller nip widths that lead to insufficient fixing of the toner image and/or poor image quality, as well as to poor stripping of the image receiving substrate).

In addition to these failure modes, it is at times desired that the nip width in a fuser be altered on demand. For instance, the fusing quality on thick paper is improved with large nip widths, and the fusing quality on thin papers is often improved with small nip widths. The fusing latitude in the presence of varied media and images, therefore, is improved if the nip width can be accurately set, controlled, and adjusted.

Typically, resetting the nip width to improve fusing latitude or to compensate for system failures due to the fuser system falling out of specifications has been dealt with by either (a) having a technician re-set the nip on site and/or (b) setting the nip width far above specifications at the factory, permitting the device to operate longer before falling out of specification. However, each of these 'solutions' has serious problems. Using technicians to reset the nip requires an on site visit by a technician and down time of the device. Initially setting the nip width high above specifications usually causes paper handling and stripping issues, especially with lightweight papers.

Optimal fusing of toner images requires the correct combination of fuser temperature, pressure, and time (dwell) in the nip which is heavily influenced by the media properties (weight, roughness, coating, thermal conductivity, etc.). The ideal fusing system would have the ability to instantaneously adjust these parameters to match media and image characteristics while maintaining xerographic process speeds. The current method to accommodate fusing of a wide range of media is to change the speed of the paper path (loss in productivity) and/or change the temperature (life reduction and time consuming) of the fuser. Any decrease in productivity or increase in idle time is considered a customer dis-satisfier and to be avoided.

A fuser system, in particular its pressure member, optimized for heavy weight or thick papers is very different than one optimized for light weight or thin papers. Heavy weight papers require longer dwells, but also require lower image-side creep due to their increased beam strength. Light papers do not require long dwells, but do require high image-side creep. Therefore, a fuser optimized for thin papers would have a relatively hard pressure member, producing high fuser member creep but small dwells, while a fuser optimized for thick papers would have a relatively soft pressure member, producing long dwells but low fuser member creep. Current fusers, especially for color machines, cannot produce the nip conditions to simultaneously support both thin and thick papers at speeds beyond 100 ppm, without resorting to temperature changes, speed changes, or load changes.

SUMMARY

The present disclosure provides a fuser system of a xerographic device comprising a fuser member, and a pressure member supported for pressure engagement with the fuser member. The pressure member includes at least one inner layer and at least one outer layer. The inner layer is variably pressurized for controlled change of the effective hardness of the pressure member.

The present disclosure also provides a xerographic method including operating a heat and pressure fuser including a heated fuser member and a pressure member. The pressure member includes a variable pressure for selectively imparting a first nip width between the fuser member and the pressure member. The method further provides for selectively changing the first nip width to at least a second nip width in response to a defined signal, which might be due to a change in media, a change in image content, or due to a change in state of the machine.

The present disclosure also provides a fuser system of a xerographic device comprising a fuser member and a pressure member having an outer layer and an inner bladder. The inner bladder is adapted for variable pressurization. The fuser system further provides a sensor cooperating with the pressure member and the bladder for operatively selecting an effective modulus for the pressure member.

DETAILED DESCRIPTION

A typical xerographic machine includes at least a toner image forming station, a transfer station to transfer the toner image to an image receiving substrate, and a fuser system to fix the toner image to the image receiving substrate. At the toner image forming station, a latent image of an original image is developed, typically on the surface of a photoconductor or photoreceptor, using a suitable toner material. The developed toner image is then transferred to an image receiving substrate such as paper, transparencies, stock, media, etc., at a transfer station. Following transfer to the image receiving substrate, the toner image must then be fixed to the image receiving substrate, which is done by a fuser system that applies heat and pressure to the substrate having the toner image thereon.

It is desirable to have the ability to selectively modify the dwell time (nip width at constant speed) for a given fuser and set temperature in order to enable the rapid optimization of fix and gloss for a given toner image on a given substrate having a weight, thickness, etc. It is well understood in color fusing systems that thick papers require more and thin papers less dwell time at the same pressure and temperature to achieve adequate image permanence and gloss. It is also known that light weight media require greater nip creep and higher creep rate upon nip exit than do thicker substrates in order to promote self stripping.

A pressure member whose hardness can be tuned for thin vs. thick paper can be accomplished by using a variably pressurized pressure member that is capable of quick and controlled change of its effective hardness, thus enabling the modification of the dwell time and stripping characteristics tailored to the specific incoming media. This provides for quick alteration of the pressure member in order to accommodate maximum productivity for an entire range of media, image area coverage, fluctuations in fuser member effective hardness, and/or desired image gloss. The alterations can be made without the need to cool down and manually replace the pressure member.

Figure 1:
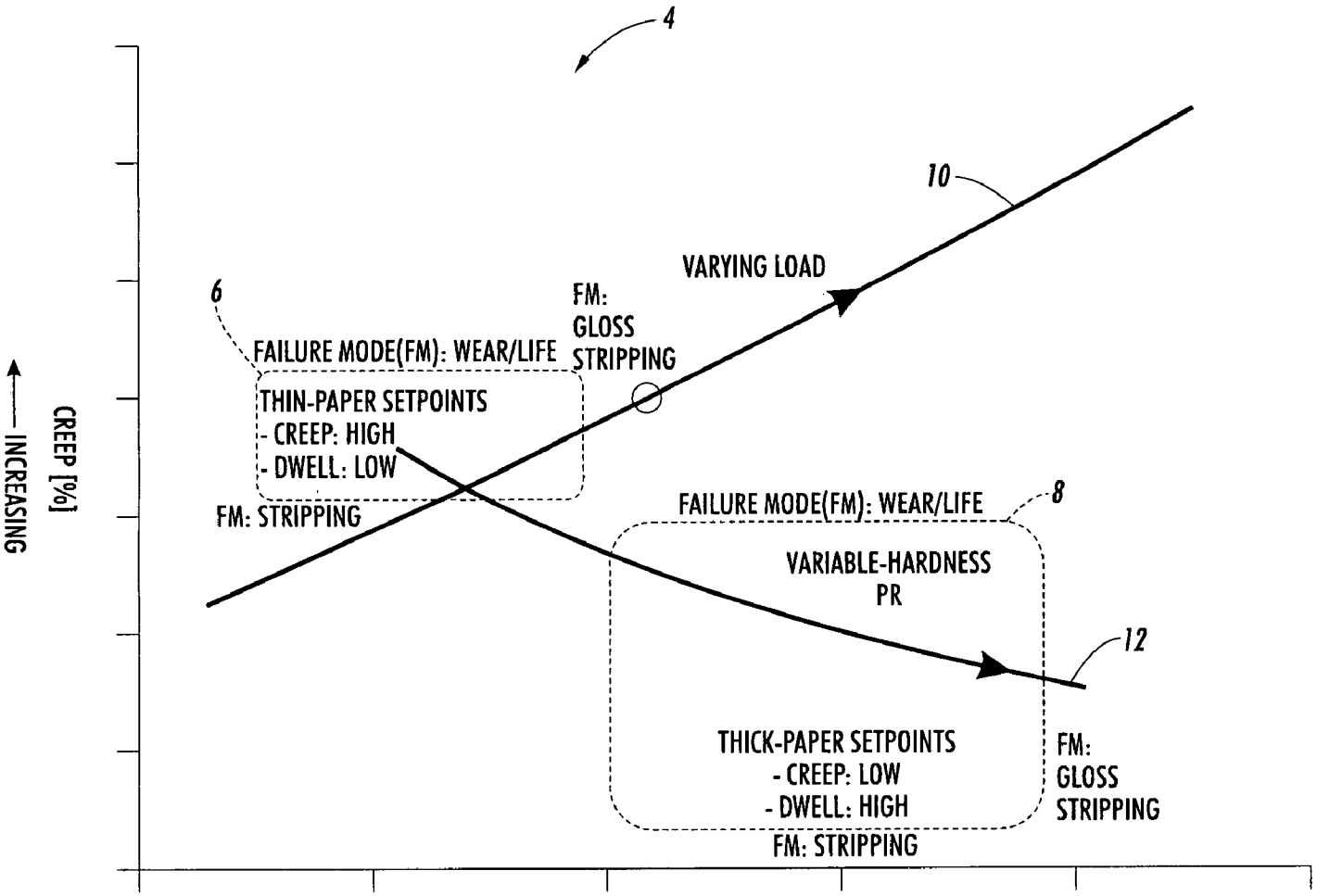
FIG. 1 illustrates the relationship between the fuser member (F/M) surface creep and dwell time, along with representative setpoints for thin and thick paper.

Heavyweight papers require more fusing (higher temperature, pressure, dwell) but less assistance in stripping due to the relatively larger beam strength. FIG. 1 displays a series of fusing conditions 4 for thin paper (e.g., approximately 67-90 grams/square meter [gsm]) and thick paper (e.g., approximately 140-270 gsm) for a color fusing system. The thin papers require high image side creep but relatively short or low dwells (i.e. area setpoints 6), while the thick papers require long or high dwells and relatively little or low creep (i.e. area setpoints 8).

The system and method described hereinafter provides for quick change of the nip conditions between the two representative areas or sets of setpoints 6, 8. It is to be appreciated that simply changing the load, represented by line 10, on an existing configuration does not transition between these two areas 6, 8. Line 12 represents the nip space created by changing the pressure member hardness, rather than load. Changing the effective hardness of the pressure member creates a configuration that can satisfy both the desired thin-paper setpoints 6 and the desired thick-paper setpoints 8.

Figure 2:
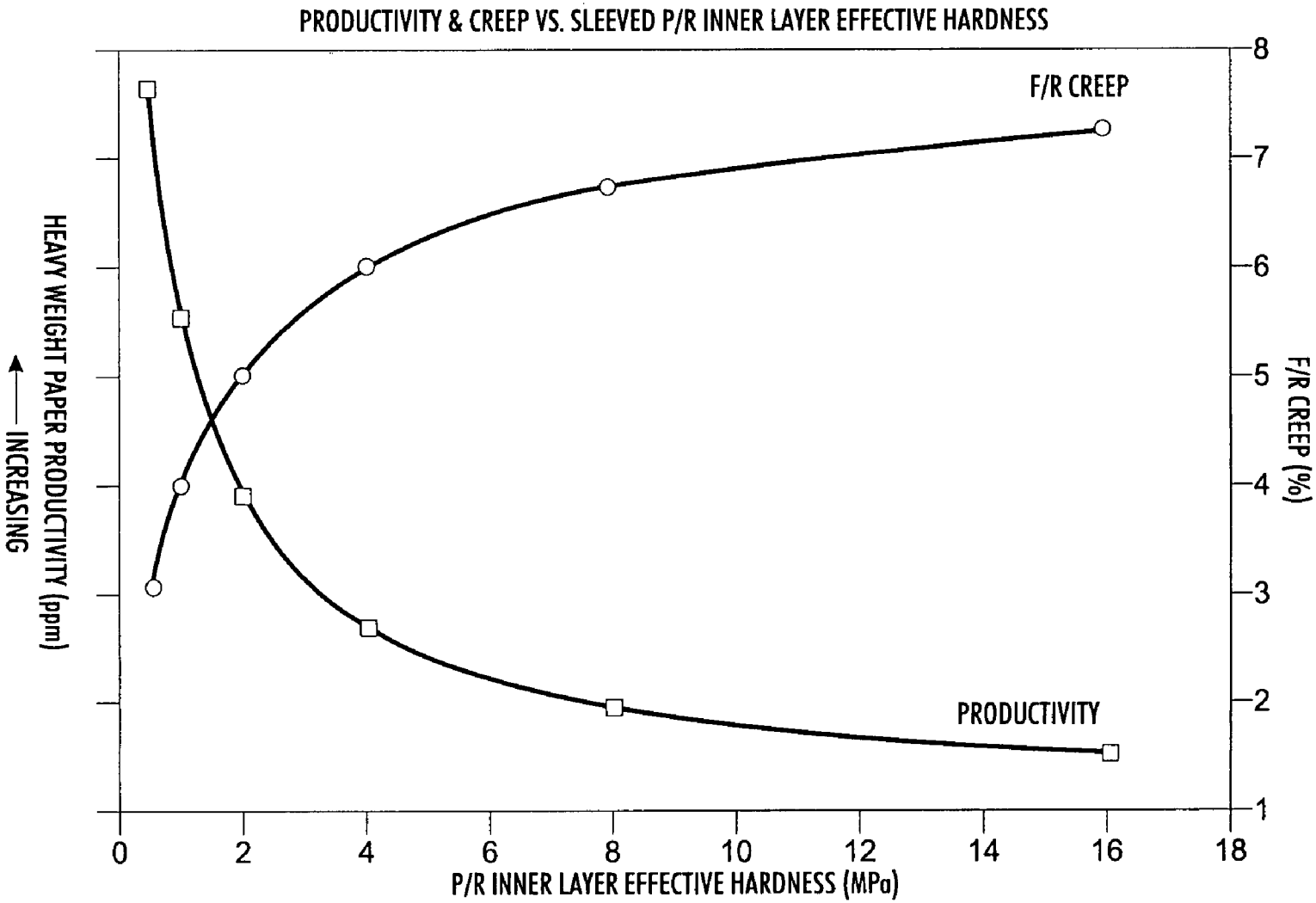
FIG. 2 illustrates the relationship between productivity (ppm) and creep relative to an effective hardness of a pressure member (P/M) inner layer.
Figure 3:
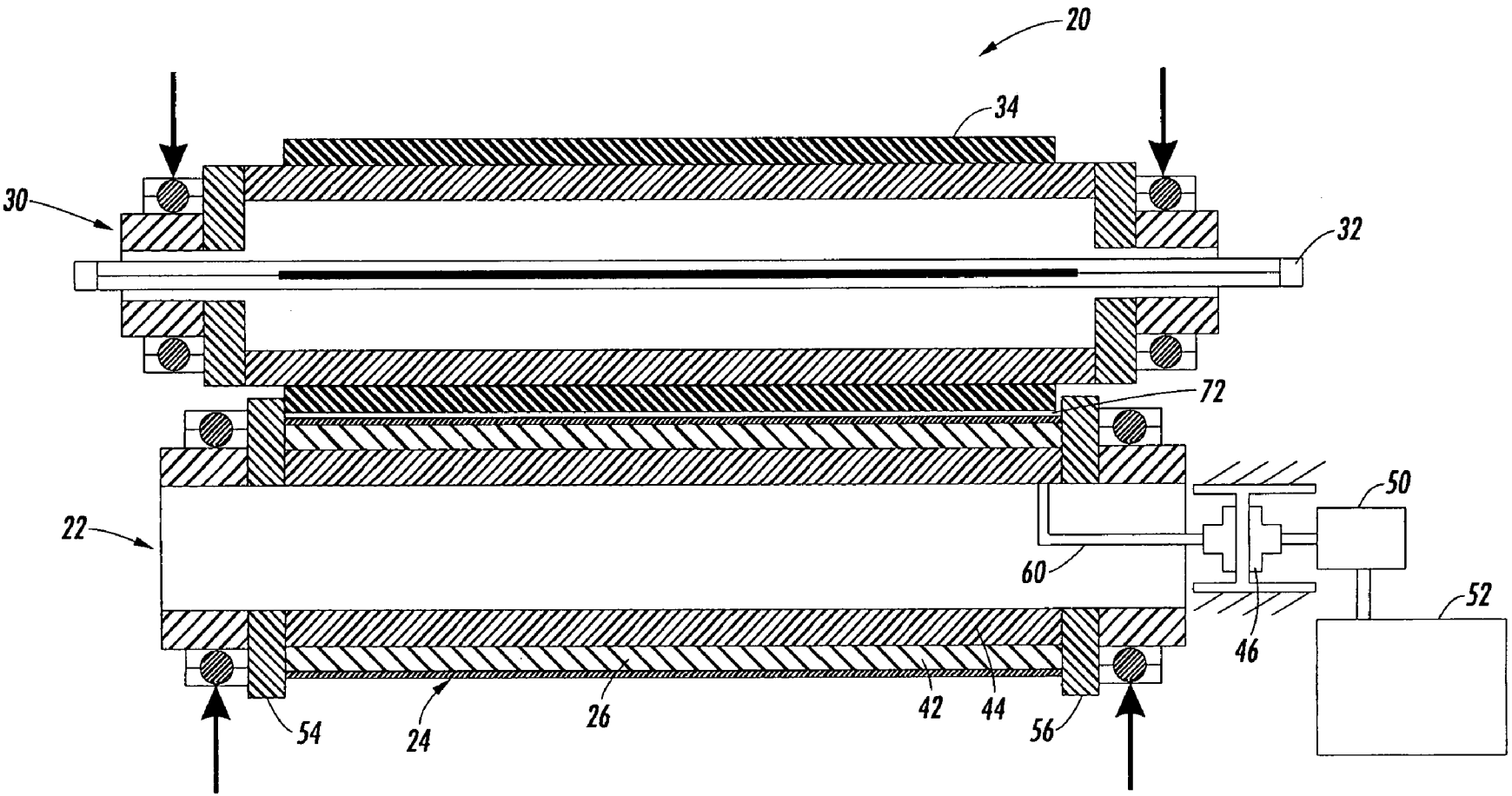
FIG. 3 illustrates one embodiment of a fuser system including a pressure member having an effective hardness that can be variably controlled; and, FIG. 4 illustrates another embodiment of a fuser system including a nip control member that can variably control the effective hardness of a pressure member.

Referring now to FIGS. 2 and 3, rapid alteration of the effective hardness of the pressure member, without manual intervention and the corresponding machine downtime, can be provided by a fuser system 20 of the present disclosure. The fuser system 20 assembly comprises a pressure member 22 including an outer layer 24 and an inner layer 26 that can be selectively pressurized to produce a change in effective hardness of the pressure member 22. The fuser system 20 further includes a fuser member 30. The fuser member 30 can be an unpressurized standard elastomer molded/coated member including a central or core heat lamp 32 and any number of layers 34.

The fuser member 30 can be comprised of, for example, a fuser belt traveling around one or more (fuser) rolls. The term "fuser roll" as used herein collectively refers to any configuration of a fuser used to contact the toner image in fixing the toner image to the image receiving substrate. Similarly, the fuser systems of the present disclosure are comprised of pressure members that may be comprised of, for example, a pressure roll, or a pressure belt traveling around one or more rolls. The term "pressure member" as used herein collectively refers to any member loaded against the fuser member and used to apply pressure to the image and media substrate passed between the fuser member and pressure member.

As shown in FIG. 2, as the pressure roll 22 is pressurized it appears harder and the fuser roll surface creep inside the fusing nip increases. As described above, hard pressure rolls reduce the fusing nip for thick media. Changing the nip and creep by changing the pressure roll effective hardness provides for the fusing and stripping requirements of thick and thin papers, as well as medium weight paper (i.e. approximately 90-140 gsm). Setting the pressure roll pressure high (high fuser creep) enables good stripping of thin papers, while at the same time reduces the tendency to over fuse. Lowering the pressure roll hardness creates a very large nip (long dwell) and ensures permanence on heavy stocks. Increasing the pressure roll hardness reduces the creep (self-strippability) in the nip, but since heavy papers need little stripping assistance this is much less an issue.

Pressure roll 22 can be constructed so as to maintain a constant (or desired variability) circumference across the entire length of the roll. One embodiment of the fuser system 20, shown in FIG. 3, provides an inner layer 26 comprising a tubular bladder 42 slid over a metal pressure member core 44. The bladder 42 can be fitted to a rotatable connector 46 and pressure controlled via a valve solenoid 50 with pressure transducer. The relatively high pressure, for example, 50-250 psi can be supplied by an independent compressor 52. The outer layer 24 surrounds the bladder 42 and comprises a sleeve/belt having a high temperature and relatively in-extensible and flexible material (i.e. steel, aluminum, nickel, Teflon®, polyimide, etc.). The sides of the bladder 42 can be constrained by shoulders 54, 56 on the pressure roll 22. A rotatable valve 60, in fluid communication with the bladder 42, can be used for controlling the variable pressure of the inner layer 26.

Pressure roll 22 is brought to exert pressure upon fuser roll 30, thereby forming the nip (not illustrated) between the pressure roll 22 and fuser roll 30. The image receiving substrate 72 having a toner image thereon is made to pass through the nip such that the toner image contacts the fuser roll surface. The toner image is fixed to the image receiving substrate 72 via heat and pressure. As the image receiving substrate 72 exits from the fuser system 20, the image receiving substrate is stripped from the fuser member 30. Preferably, the stripping is a self-stripping, although stripping fingers or other stripping devices may also be used to assist in the stripping as is well known in the art.

Figure 4:
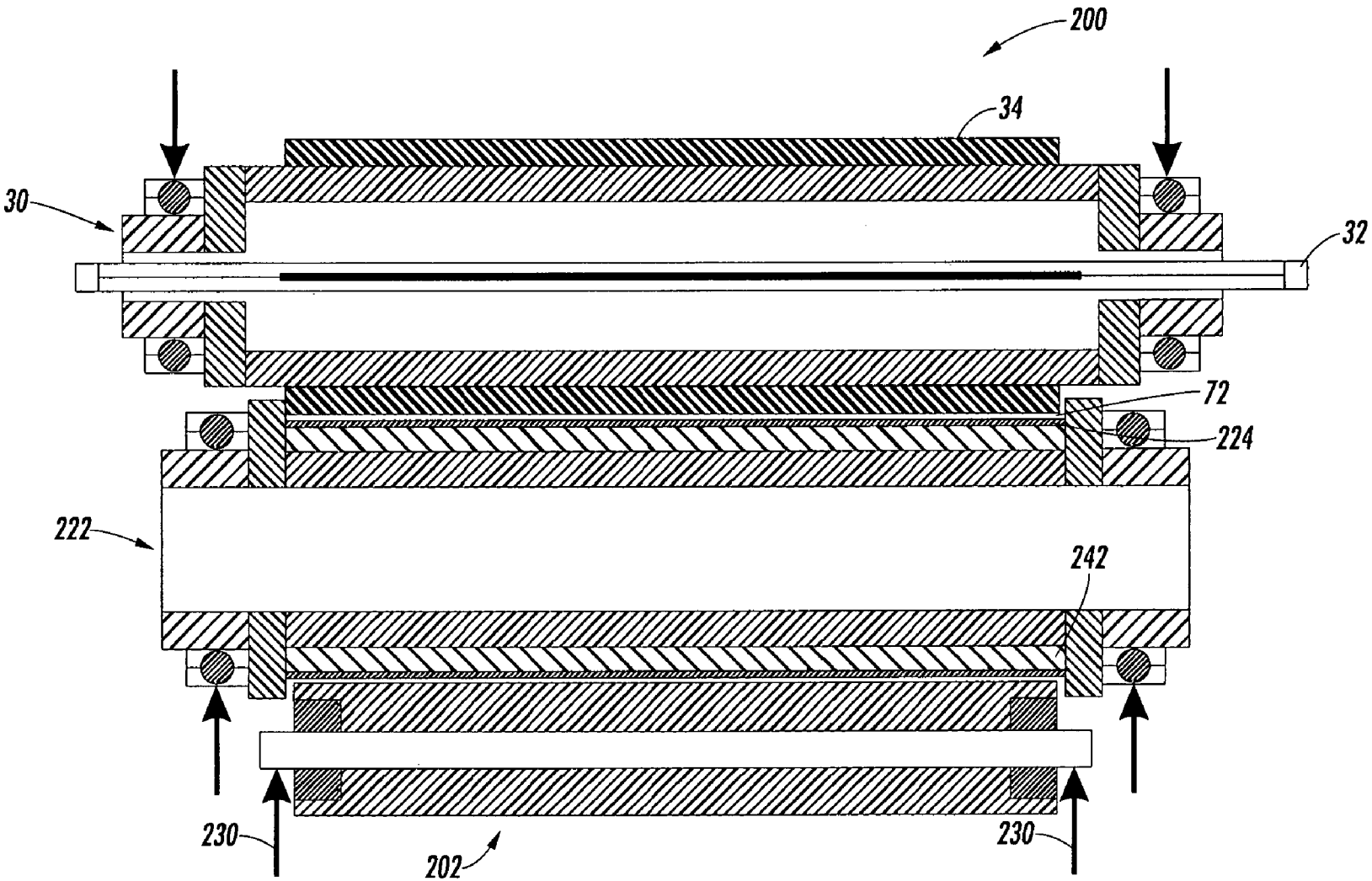

Referring now to FIG. 4 wherein another embodiment of a fuser system is therein shown. Same reference numbers are used for same elements and new reference numbers identify new elements. Rapid alteration of the effective hardness of the pressure roll, without manual intervention and the corresponding machine downtime, can be provided by a fuser system 200 of the present disclosure. The fuser system 200 includes a second roller or nip control roll 202 positioned opposite (or distal to) the fuser roll 22 to manage the pressure of a sealed bladder 242. The nip control roll 202 can impart a variable force to a pressure member 222 thereby controlling the nip pressure between the fuser roll 22 and the pressure roll 222. In this embodiment, the pressure roll 222 can include a liquid filled incompressible bladder 242 and an outer layer 224. The greater the nip control member 202 indentation, the greater the pressure roll effective hardness.

The fuser systems 20, 200 can also include a lookup table or a sensor (not illustrated) for feeding back a signal which can be used to set a pressure roll effective hardness for a given media type or weight, image content, or other signal associated with a machine state. One example of a sensor is a gloss meter output sensor which can be used for detecting a gloss of an image on media passing through the xerographic device. Another example of a sensor is an input sensor for detecting a weight of media passing between the fuser roll and pressure roll. The sensor can send signals to the valve solenoid 50 or the nip control roll 202 of the pressure rolls 20, 200 in order to control the variable pressure between the respective pressure roll and fuser roll and thereby operatively selecting an effective modulus for the outer layer of the pressure roll. In this manner, the effective hardness that is best suited for the particular incoming media, or best suited for the particular gloss of an image, is applied to the pressure roll and loaded against the fuser roll 30. The lookup table provides the inputs for changing the nip pressure from one nip pressure to another nip pressure based on the weight of media and the associated setpoints, i.e. setpoints 6, 8.

In the present disclosure, paper weight and/or a signal from which appropriate nip conditions in the fusing system can be derived is monitored. The monitoring device may provide the measured values for the paper weight while the digital front end may communicate the image content to a processor (not illustrated). Additionally, image gloss of previously fused images may be provided by another monitoring device or customer identification. These values are then used in a lookup table or calculation within the machine to determine the optimized nip conditions of the fuser. If the current nip conditions in the fusing systems 20, 200 (pressure, nip width, creep, etc.) are outside the optimized specifications, then the processor signals a pressure roll hardness adjustment device to appropriately adjust the pressure in the pressure member system.

It is to be appreciated that the monitoring device may be a sensor for any of numerous values within the fuser systems 20, 200, for example for directly monitoring nip width or indirectly monitoring indicators of nip width such as paper speed exiting from the fuser system, paper buckle prior to entering the fuser system, fuser roll to pressure roll center-to-center distribution, load between the fuser roll and pressure roll, pressure within the pressurized bladder, etc.

The monitoring sensor is in communication with the processor (not illustrated) so that the data measured by the sensor may be sent to the processor. Although wireless communication is possible, it is typically suitable to use conventional cabling between the sensor and the processor in order for the processor to be able to reliably receive the data from the monitoring sensor.

The processor evaluates the received data to determine a value for the measured, or current, nip conditions (i.e. nip width nip pressure, bladder pressure, load, etc.) of the fuser system. Where the received data is the paper weight in grams per square meter (gsm), the data is converted to a desired nip condition value by the processor. This can be done by any suitable means, for example through use of the lookup table stored in the processor. Such a lookup table can store the nip conditions corresponding to various paper weights. The processor may also calculate the desired nip condition values from the paper weight data using an appropriate function equation stored in the processor.

For example, in the event materials of the fuser member have hardened such that the current nip width has been reduced to fall outside of the nip width specification range, a nip width adjustment device is signaled to increase the load on the system, thereby increasing the pressure exerted by the pressure member against the fuser member so that the nip width is increased to again fall within the desired operational specification range. By increasing the load, one can increase the nip width and dwell to be within the specifications, which has the benefit of also correcting any drift in the paper velocity that may have occurred. By way of illustration only, fuser system 20 increases load by increasing the pressure in bladder 42. Fuser system 200 increases load by increasing the pressure of control member 202 on pressure member 222. The load of system 200 is depicted by arrows 230.

The disclosure thus enables the fuser latitude to be increased, and fuser life to be lengthened and maintenance upon the fuser system to be reduced as a result of automating the nip width adjustment of the fuser. The nip width is adjusted to maximize fusing performance over life, and monitored so that the nip width can be appropriately adjusted, by the xerographic device itself, and thus image quality, stripping, etc., does not suffer.

Having described various embodiments of the present disclosure (which are intended to be illustrative and not limiting), it is noted that modifications and variations can be made by persons of ordinary skill in the art in light of the above teachings. It is therefore to be understood that changes may be made in the particular embodiments of the disclosure disclosed which are within the scope and spirit of the disclosure as defined by the appended claims.

What is claimed is:

1. A fuser system of a xerographic device, comprising:
a fuser member;
a pressure member supported for pressure engagement with said fuser member;
said pressure member includes at least one inner layer and at least one outer layer, said at least one inner layer is variably pressurized for controlled change of the effective hardness of said pressure member; and,
said at least one inner layer includes a tubular bladder around a core for selectively imparting a first nip width and at least a second nip width between said fuser member and said pressure member.

2. A fuser system of a xerographic device, comprising:
a fuser member;
a pressure member supported for pressure engagement with said fuser member;
said pressure member includes at least one inner layer and at least one outer layer, said inner layer is variably pressurized for controlled change of the effective hardness of said pressure member;
said at least one inner layer includes a tubular bladder around a core; and,
a rotatable valve connected to said bladder for controlling said variable pressure of said at least one inner layer.

3. The device of claim 1 wherein said at least one outer layer is a substantially in-extensible and flexible material.

4. The device of claim 3 wherein said material is selected from the group consisting of steel, aluminum, nickel, Teflon®, and polyimide.

5. A fuser system of a xerographic device, comprising:
a fuser member;
a pressure member supported for pressure engagement with said fuser member;
said pressure member includes at least one inner layer and at least one outer layer, said inner layer is variably pressurized for controlled change of the effective hardness of said pressure member; and,
a sensor for detecting weight of media passing through the xerographic device and controlling said variable pressure of said at least one inner layer in response thereto.

6. A fuser system of a xerographic device, comprising:
a fuser member;
a pressure member supported for pressure engagement with said fuser member;
said pressure member includes at least one inner layer and at least one outer layer, said inner layer is variably pressurized for controlled change of the effective hardness of said pressure member; and,
an output sensor for detecting a gloss of an image on media passing through the xerographic device, said sensor controlling said variable pressure of said at least one inner layer in response thereto.

7. A fuser system of a xerographic device, comprising:
a fuser member;
a pressure member supported for pressure engagement with said fuser member;
said pressure member includes at least one inner layer and at least one outer layer, said inner layer is variably pressurized for controlled change of the effective hardness of said pressure member;
said at least one inner layer includes a tubular bladder around a core; and, said bladder is liquid filled.

8. A fuser system of a xerographic device, comprising:
a fuser member;
a pressure member supported for pressure engagement with said fuser member;
said pressure member includes at least one inner layer and at least one outer layer, said inner layer is variably pressurized for controlled change of the effective hardness of said pressure member;
said at least one inner layer includes a tubular bladder around a core; and, said bladder is gas filled.

9. A fuser system of a xerographic device, comprising:
a fuser member;
a pressure member supported for pressure engagement with said fuser member;
said pressure member includes at least one inner layer and at least one outer layer, said inner layer is variably pressurized for controlled change of the effective hardness of said pressure member;
said at least one inner layer includes a tubular bladder around a core; and, said bladder changes from a first pressure to at least a second pressure, said first pressure resulting in a first nip width between said fuser member and said pressure member and said at least second pressure resulting in at least a second nip width between said fuser member and said pressure member.

10. A xerographic method including:
operating a heat and pressure fuser including a heated fuser member and a pressure member, said pressure member including at least one inner layer and at least one outer layer, said at least one inner layer having a variable pressure for selectively imparting a first nip width between said fuser member and said pressure member; and,
selectively changing said first nip width to at least a second nip width in response to a defined signal.

11. The method of claim 10 wherein said defined signal is selected from the group consisting of a change in media, a change in image content, and a change in state of said fuser.

12. A xerographic method including:
operating a heat and pressure fuser including a heated fuser member and a pressure member, said pressure member having a variable pressure for selectively imparting a first nip width between said fuser member and said pressure member;
selectively changing said first nip width to at least a second nip width in response to a defined signal; and,
wherein said pressure member includes a tubular bladder over a metal core, said bladder connected to a rotatable valve for controlling said variable pressure of said pressure member.

13. The method of claim 12 wherein said controlling said variable pressure includes a solenoid.

14. The method of claim 12 further including:
a compressor for supplying said variable pressure.

15. The method of claim 10 further including:
a nip control member positioned distal to said fuser member for imparting said first nip width and said at least second nip width.

16. The method of claim 10 further including:
using a lookup table wherein a sensor detects said weight of media and changes said variable pressure from imparting said first nip to said at least second nip according to said lookup table.

17. A fuser system of a xerographic device, comprising:
a fuser member;
a pressure member having an outer layer and an inner bladder, said bladder adapted for variable pressurization wherein said bladder changes from a first pressure to at least a second pressure, said first pressure resulting in a first nip width between said fuser member and said pressure member and said at least second pressure resulting in at least a second nip width between said fuser member and said pressure member; and, a sensor cooperating with said pressure member and said bladder for operatively selecting an effective modulus for said pressure member.

18. The system of claim 17 wherein said bladder is tubular and surrounds an inner core of said pressure member.

19. The system of claim 17 wherein said bladder is connected to a rotatable valve for pressure control of said bladder.

20. The system of claim 17 further including a substantially in-extensible belt surrounding said bladder.

21. The system of claim 17 further including a pair of shoulders at opposing ends of said bladder for constraining said bladder.

22. The system of claim 17 wherein said bladder is a liquid filled incompressible bladder.

23. The system of claim 22 further including a nip control member distal to said fuser member for controlling said variable pressure of said bladder.

* * * * *